US011790841B2

(12) United States Patent
Yu et al.

(10) Patent No.: US 11,790,841 B2
(45) Date of Patent: Oct. 17, 2023

(54) PIXEL AND DISPLAY DEVICE INCLUDING THE SAME

(71) Applicant: Samsung Display Co., Ltd., Yongin-Si (KR)

(72) Inventors: Byung Chang Yu, Yongin-si (KR); Hyun Joon Kim, Yongin-si (KR); Hae Min Kim, Yongin-si (KR); Myung Hoon Park, Yongin-si (KR); Dong Hoon Lee, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 18/073,311

(22) Filed: Dec. 1, 2022

(65) Prior Publication Data

US 2023/0196986 A1 Jun. 22, 2023

(30) Foreign Application Priority Data

Dec. 22, 2021 (KR) ..... 10-2021-0185182

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0852* (2013.01);
(Continued)

(58) Field of Classification Search
CPC ..... G09G 3/32; G09G 3/3233; G09G 2300/0852; G09G 2310/0267;
(Continued)

(56) References Cited

U.S. PATENT DOCUMENTS 9,626,905 B2 4/2017 In et al.
9,917,272 B2 3/2018 Voges et al.
(Continued)

FOREIGN PATENT DOCUMENTS

KR 10-2015-0138527 A 12/2015
KR 10-2023232 B1 9/2019
(Continued)

*Primary Examiner* — Amare Mengistu
*Assistant Examiner* — Gloryvid Figueroa-Gibson
(74) *Attorney, Agent, or Firm* — Innovation Counsel LLP

(57) ABSTRACT

A pixel and a display device including the same are disclosed. The pixel includes a light emitting element, first through seventh transistors, and a first capacitor. The first transistor is connected between first and second nodes. The second transistor is connected between a data line and a fourth node and configured to be turned on by a first scan signal. The third transistor is connected between the first node and a third node and configured to be turned on by a second scan signal. The fourth transistor is connected between the fourth node and a third power line and configured to be turned on by a third scan signal. The fifth transistor is connected between the third node and the third power line and configured to be turned on by a fourth scan signal. The sixth transistor is connected between the first node and a fifth node and configured to be turned off by an emission control signal. The seventh transistor is connected between the second node and the second power line and configured to be turned off in response to the emission control signal. The first capacitor is connected between the third and fourth nodes.

20 Claims, 11 Drawing Sheets

(52) U.S. Cl.
CPC ..... *G09G 2310/0267* (2013.01); *G09G 2310/0275* (2013.01); *G09G 2320/0233* (2013.01); *G09G 2330/021* (2013.01)

(58) Field of Classification Search
CPC ... G09G 2310/0275; G09G 2320/0233; G09G 2330/021
See application file for complete search history.

(56) References Cited

U.S. PATENT DOCUMENTS

| | | | | |
|---|---|---|---|---|
| 10,923,038 | B2 | 2/2021 | Kim et al. | |
| 11,114,033 | B2 | 9/2021 | Park et al. | |
| 2009/0108763 | A1* | 4/2009 | Han | G09G 3/3233 315/169.3 |
| 2011/0227885 | A1* | 9/2011 | Chung | G09G 3/3233 345/204 |
| 2015/0348464 | A1* | 12/2015 | In | G09G 3/2022 345/82 |
| 2018/0145127 | A1* | 5/2018 | Shin | H10K 50/844 |
| 2021/0174743 | A1 | 6/2021 | Chang | |
| 2022/0101793 | A1* | 3/2022 | Yu | G09G 3/3233 |

FOREIGN PATENT DOCUMENTS

| | | | |
|---|---|---|---|
| KR | 10-2020-0053969 | A | 5/2020 |
| KR | 10-2021-0011554 | A | 2/2021 |
| KR | 10-2021-0073188 | A | 6/2021 |

* cited by examiner $V3 = Vref - Vth$
$V5 = Vint$ $$V3 = (Vref - Vth) + \alpha$$

$$V4 = VDATA$$

$$\alpha = \frac{Cp1}{Cp1 + Cp2} \times (VDATA - Vref)$$

PIXEL AND DISPLAY DEVICE INCLUDING THE SAME

CROSS-REFERENCE TO RELATED APPLICATION

The present application claims priority to Korean patent application number 10-2021-0185182 filed on Dec. 22, 2021, the entire disclosure of which is incorporated herein in its entirety by reference.

BACKGROUND

Field of Invention

The present disclosure relates to a pixel and a display device including the pixel.

Description of Related Art

A display device may include a plurality of pixels. Each of the pixels may include a plurality of transistors, a light emitting element electrically connected to the transistors, and a capacitor. The transistors may generate driving current based on signals provided through signal lines. The light emitting element may emit light based on the driving current.

To enhance the driving efficiency of the display device depending on driving conditions, there is a need to reduce the power consumption of the display device. For example, the power consumption of the display device may be reduced by reducing a frame frequency (or a driving frequency) when a static image is displayed. Furthermore, the display device may display an image at a high frame frequency of 120 Hz or more so as to implement a high resolution image, a stereoscopic image, or etc.

As such, to display images under various conditions, the display device may display images at various frame frequencies (or various driving frequencies).

SUMMARY

Various embodiments of the present disclosure are directed to a pixel that may secure a sufficient amount of threshold voltage compensation time, and prevent (or remove) deterioration in display quality due to variation in hysteresis characteristics of a driving transistor, luminance unevenness due to resistance drop, and deterioration in image quality due to current leakage in the pixel.

Various embodiments of the present disclosure are directed to a display device including the pixel.

A pixel in accordance with an embodiment of the present disclosure may include a light emitting element including a first electrode and a second electrode, a first transistor connected between a first node and a second node, and configured to generate driving current flowing from a first power line for providing a first power voltage to a second power line for providing a second power voltage via the light emitting element, a second transistor connected between a data line and a fourth node, and configured to be turned on in response to a first scan signal supplied to a first scan line, a third transistor connected between the first node and a third node corresponding to a gate electrode of the first transistor, and configured to be turned on in response to a second scan signal supplied to a second scan line, a fourth transistor connected between the fourth node and a third power line for providing a third power voltage, and configured to be turned on in response to a third scan signal supplied to a third scan line, a fifth transistor connected between the third node and the third power line, and configured to be turned on in response to a fourth scan signal supplied to a fourth scan line, a sixth transistor connected between the first node and a fifth node corresponding to the second electrode of the light emitting element, and configured to be turned off in response to an emission control signal supplied to an emission control line, a seventh transistor connected between the second node and the second power line, and configured to be turned off in response to the emission control signal, and a first capacitor connected between the third node and the fourth node.

In an embodiment, the first electrode of the light emitting element may be connected to the first power line.

In an embodiment, each of the first to seventh transistors may be an N-type oxide semiconductor transistor.

In an embodiment, the pixel may further include an eighth transistor connected between the fifth node and a fourth power line for providing a fourth power voltage, and configured to be turned on in response to a fifth scan signal supplied to a fifth scan line.

In an embodiment, the pixel may further include an eighth transistor connected between the fifth node and the first power line, and configured to be turned on in response to a fifth scan signal supplied to a fifth scan line.

In an embodiment, the pixel may further include a ninth transistor connected between the second node and a fifth power line for providing a fifth power voltage, and configured to be turned on in response to a fifth scan signal supplied to a fifth scan line.

In an embodiment, the pixel may further include a ninth transistor connected between the second node and the first power line, and configured to be turned on in response to a fifth scan signal supplied to a fifth scan line.

In an embodiment, the pixel may further include a second capacitor connected between the second power line and the fourth node.

In an embodiment, a period in which the third transistor is turned on may overlap at least a portion of a period in which the fourth transistor is turned on.

In an embodiment, a period in which the fifth transistor is turned on may overlap at least a portion of a period in which the fourth transistor is turned on.

In an embodiment, the first scan signal may be a signal obtained by shifting the fourth scan signal.

A display device in accordance with an embodiment of the present disclosure may include a pixel connected to a first scan line, a second scan line, a third scan line, a fourth scan line, a fifth scan line, an emission control line, and a data line, a scan driver configured to supply a first scan signal, a second scan signal, a third scan signal, a fourth scan signal, and a fifth scan signal to the first scan line, the second scan line, the third scan line, the fourth scan line and the fifth scan line, respectively, an emission driver configured to supply an emission control signal to the emission control line, and a data driver configured to supply a data signal to the data line. The pixel may include a light emitting element including a first electrode and a second electrode, a first transistor connected between a first node and a second node, and configured to generate driving current flowing from a first power line for providing a first power voltage to a second power line for providing a second power voltage via the light emitting element, a second transistor connected between the data line and a fourth node, and configured to be turned on in response to the first scan signal, a third transistor connected between the first node and a third node corresponding to a gate electrode of the first transistor, and configured to be turned on in response to the second scan signal, a fourth transistor connected between the fourth node and a third power line for providing a third power voltage, and configured to be turned on in response to the third scan signal, a fifth transistor connected between the third node and the third power line, and configured to be turned on in response to the fourth scan signal, a sixth transistor connected between the first node and a fifth node corresponding to the second electrode of the light emitting element, and configured to be turned off in response to the emission control signal, a seventh transistor connected between the second node and the second power line, and configured to be turned off in response to the emission control signal, and a first capacitor connected between the third node and the fourth node.

In an embodiment, the first electrode of the light emitting element may be connected to the first power line.

In an embodiment, each of the first to seventh transistors may be an N-type oxide semiconductor transistor.

In an embodiment, the pixel may further include an eighth transistor connected between the fifth node and a fourth power line for providing a fourth power voltage, and configured to be turned on in response to the fifth scan signal.

In an embodiment, the pixel may further include an eighth transistor connected between the fifth node and the first power line, and configured to be turned on in response to the fifth scan signal.

In an embodiment, the pixel may further include a ninth transistor connected between the second node and a fifth power line for providing a fifth power voltage, and configured to be turned on in response to the fifth scan signal.

In an embodiment, the pixel may further include a ninth transistor connected between the second node and the first power line, and configured to be turned on in response to the fifth scan signal.

In an embodiment, the pixel may further include a second capacitor connected between the second power line and the fourth node.

In an embodiment, a period in which the scan driver supplies the second scan signal may overlap at least a portion of a period in which the scan driver supplies the third scan signal.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
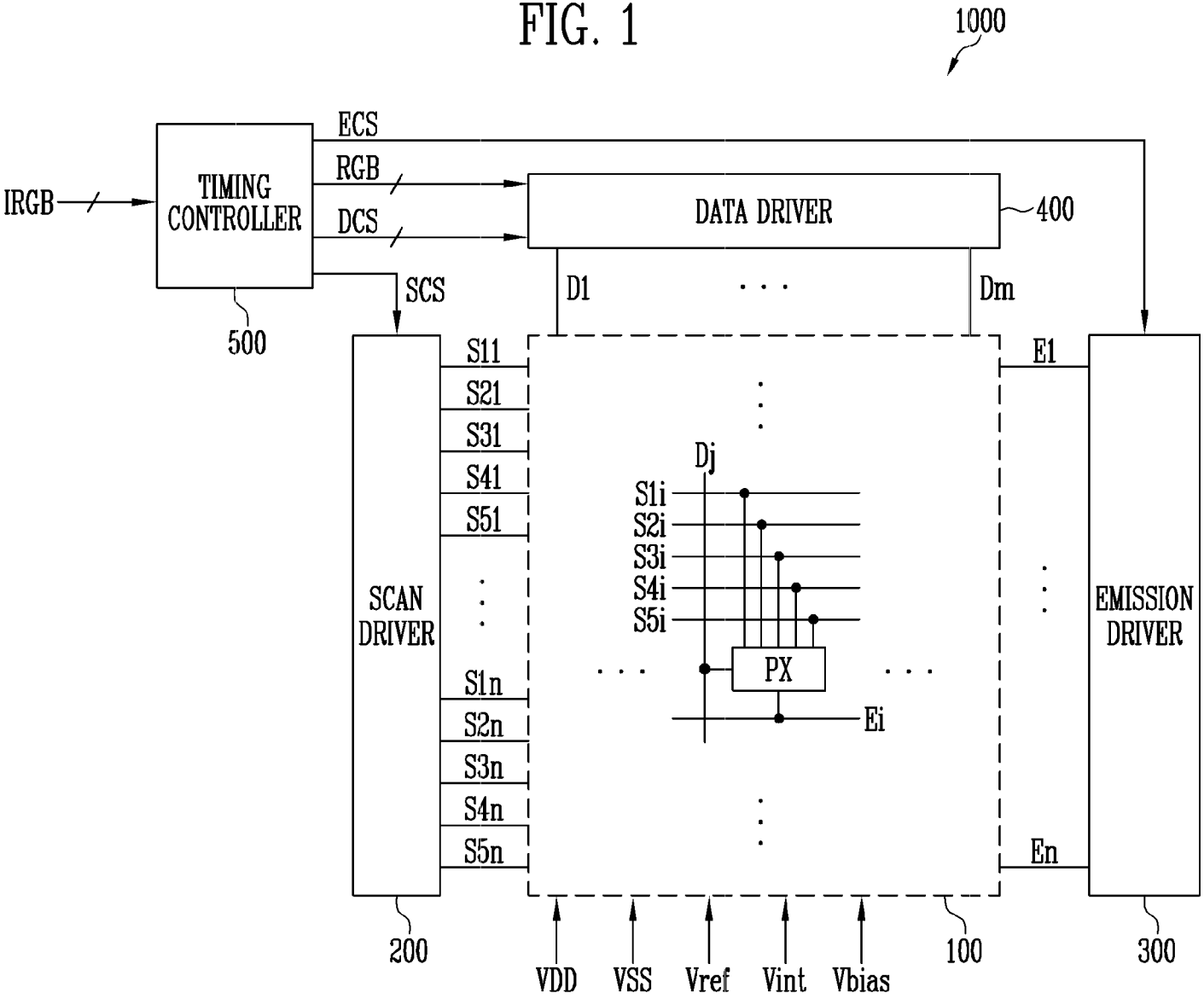
FIG. 1 is a block diagram illustrating a display device in accordance with embodiments of the present disclosure.

Various embodiments of the present disclosure will hereinafter be described in detail with reference to the accompanying drawings. The same reference numerals are used throughout the different drawings to designate the same components, and repetitive description of the same components will be omitted.

As used herein, the word "or" means logical "or" so, unless the context indicates otherwise, the expression "A, B, or C" means "A and B and C," "A and B but not C," "A and C but not B," "B and C but not A," "A but not B and not C," "B but not A and not C," and "C but not A and not B."

FIG. 1 is a block diagram illustrating a display device 1000 in accordance with embodiments of the present disclosure.

Referring to FIG. 1, the display device 1000 in accordance with embodiments of the present disclosure may include a pixel component 100 (e.g., a display panel), a scan driver 200, an emission driver 300, a data driver 400, and a timing controller 500.

The display device 1000 may display images at various frame frequencies (refresh rates, or driving frequencies) depending on driving conditions. A frame frequency may refer to a rate at which a data signal is substantially written per second to a driving transistor of the pixel PX included in the pixel component 100. For example, the frame frequency may also be referred to as "scan rate" or "refresh frequency" and indicate the number of images displayed per second.

In an embodiment, a data signal output frequency of the data driver 400 or an output frequency of a scan signal (e.g., a first scan signal) to be supplied to a scan line (e.g., a first scan line) for supply of a data signal may be changed in response to the frame frequency. For example, the frame frequency for driving a video may be a frequency of approximately 60 Hz or more (e.g., 60 Hz, 120 Hz, 240 Hz, 360 Hz, or 480 Hz). For instance, in case that the frame frequency is 60 Hz, a first scan signal may be supplied to each horizontal line (each pixel row) sixty times per second.

In an embodiment, the display device 1000 may adjust, depending on driving conditions, the output frequencies of the scan driver 200 and the emission driver 300 and an output frequency of the data driver 400 corresponding thereto. For example, the display device 1000 may display images in response to various frame frequencies ranging from 1 Hz to 480 Hz. However, this is only for illustrative purposes. For example, the display device 1000 may also display images at a frame frequency of 480 Hz or more.

The pixel component 100 may include scan lines S11 to S1*n*, S21 to S2*n*, S31 to S3*n*, S41 to S4*n*, and S51 to S5*n*, emission control lines E1 to En, and data lines D1 to Dm, and may include pixels PX connected to the scan lines S11 to S1*n*, S21 to S2*n*, S31 to S3*n*, S41 to S4*n*, and S51 to S5*n*, the emission control lines E1 to En, and the data lines D1 to Dm (where m and n are integers greater than 1). Each of the pixels PX may include a driving transistor and a plurality of switching transistors.

The timing controller 500 may be supplied with input image data IRGB and control signals from a host system such as an application processor (AP) through an interface.

The timing controller 500 may control driving timings of the scan driver 200, the emission driver 300, and the data driver 400.

The timing controller 500 may generate a first control signal SCS, a second control signal ECS, and a third control signal DCS based on input image data IRGB, control signals, and the like. The first control signal SCS may be supplied to the scan driver 200. The second control signal ECS may be supplied to the emission driver 300. The third control signal DCS may be supplied to the data driver 400. The timing controller 500 may rearrange the input image data IRGB and generate image data RGB, and then supply the image data RGB to the data driver 400.

The scan driver 200 may receive the first control signal SCS from the timing controller 500, and supply a first scan signal, a second scan signal, a third scan signal, a fourth scan signal, and a fifth scan signal respectively to first scan lines S11 to S1*n*, second scan lines S21 to S2*n*, third scan lines S31 to S3*n*, fourth scan lines S41 to S4*n*, and fifth scan lines S51 to S5*n*, based on the first control signal SCS.

The first to fifth scan signals each may be set to a voltage having a gate-on level corresponding to the type of transistor to which the corresponding scan signal is supplied. A transistor that receives a scan signal may be set to a turn-on state when a scan signal is supplied thereto. For example, a gate-on level of a scan signal to be supplied to an N-channel metal oxide semiconductor (NMOS) transistor may be a logic high level. Alternatively, a gate-on level of a scan signal to be supplied to a P-channel metal oxide semiconductor (PMOS) transistor may be a logic low level. Hereinafter, the expression "scan signal is supplied" may be understood to mean that the scan signal is supplied at a logic level that enables a transistor that is controlled by the supplied scan signal to be turned on.

In an embodiment, the scan driver 200 may supply at least some of the first to fifth scan signals a plurality of times during a non-emission period. Consequently, a bias state of the driving transistor included in the pixel PX may be controlled.

Although for convenience of description FIG. 1 illustrates that the scan driver 200 is provided as a single component, the present disclosure is not limited thereto. Depending on the design, the scan driver 200 may include a plurality of scan drivers each of which supplies at least one of the first to fifth scan signals. Furthermore, at least a portion of the scan driver 200 may be integrated into a driving circuit, a module, or the like.

The emission driver 300 may supply emission control signals to the emission control lines E1 to En, based on the second control signal ECS.

The emission control signals each may be set to a gate-off level voltage (e.g., a low voltage). A transistor that receives the emission control signal may be turned off when the emission control signal is supplied thereto, and may be turned on in the other cases. Hereinafter, the expression "emission control signal is supplied" may be understood to mean that the emission control signal is supplied at a logic level (e.g., a logic low level) that enables a transistor that is controlled by the supplied emission control signal to be turned off.

The data driver 400 may receive the third control signal DCS and image data RGB from the timing controller 500. The data driver 400 may convert digital image data RGB into an analog data signal (or a data voltage). The data driver 400 may supply data signals to the data lines D1 to Dm in response to the third control signal DCS. Here, the data signals supplied to the data lines D1 to Dm may be supplied in synchronization with an output timing of the first scan signal supplied to the first scan lines S11 to S1*n*.

In an embodiment, the display device 1000 may further include a power supply. The power supply may supply, to drive the pixels PX, a first power voltage VDD, a second power voltage VSS, a third power voltage Vref (e.g., a reference voltage), a fourth power voltage Vint (e.g., an initialization voltage), and a fifth power voltage Vbias (e.g., a bias voltage) to the pixel component 100.

The display device 1000 may be operated at various frame frequencies. In case of a low frequency driving operation that is performed at a relatively low frame frequency (e.g., a frame frequency of 60 Hz or less), an image defect such as flicker attributable to current leakage in the pixel PX may be visible. Furthermore, an afterimage such as motion blur may be visible due to a change in response speed caused by a threshold voltage shift or the like resulting from a change in bias state or hysteresis characteristics of the driving transistor by driving at various frame frequencies.

To improve image quality, each frame period may include a plurality of non-emission periods and a plurality of emission periods, depending on a frame frequency. For example, an initial non-emission period and an emission period of a frame may be defined as a first driving period, and a subsequent non-emission period and a subsequent emission period may be defined as a second driving period.

For instance, a data signal for displaying an image may be substantially written to the pixel PX in the first driving period, and an on-bias may be applied to the driving transistor of the pixel PX in the second driving period.

In the case of a high frequency driving operation that is performed at a relatively high frame frequency (e.g., a frame frequency of 120 Hz or more), a sufficient amount of threshold voltage compensation time of the driving transistor is required to be secured so as to embody at least standard image quality. The pixel PX and the display device 1000 in accordance with embodiments of the present disclosure can secure a sufficient amount of threshold voltage compensation time and display high quality images at various frame frequencies.

Figure 2:
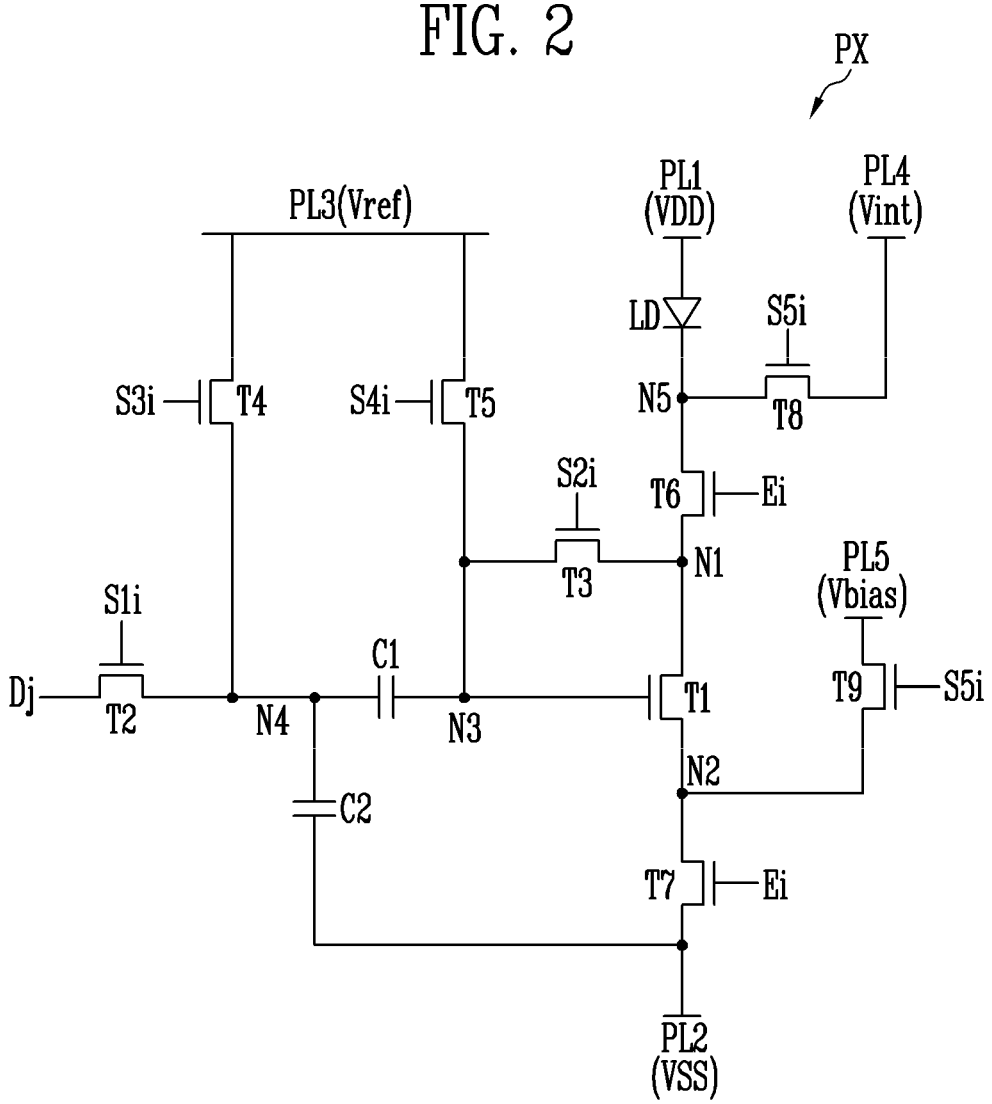
FIG. 2 is a circuit diagram illustrating an example of a pixel included in the display device of FIG. 1.

FIG. 2 is a circuit diagram illustrating an example of the pixel PX included in the display device 1000 of FIG. 1.

For convenience of description, FIG. 2 illustrates a pixel PX that is located on an i-th horizontal line (or an i-th pixel row) and connected to a j-th data line Dj (where each of i and j is a natural number greater than 0).

Referring to FIGS. 1 and 2, the pixel PX may include a light emitting element LD and a pixel circuit (or a pixel driving circuit) configured to control the amount of current that flows through the light emitting element LD.

The light emitting element LD may include a first electrode (e.g., an anode electrode) connected to a first power line PL1 configured to transmit the first power voltage VDD to the light emitting element LD, and a second electrode (e.g., a cathode electrode) connected to a second power line PL2 configured to transmit the second power voltage VSS to the light emitting element LD via the pixel circuit. For example, the light emitting element LD may be disposed to have an inverted structure in which the second electrode is connected to the pixel circuit.

The light emitting element LD may generate light having a luminance corresponding to the amount of driving current that flows from the first power line PL1 to the second power line PL2 via the pixel circuit.

In an embodiment, the light emitting element LD may be an organic light emitting diode including an organic light emitting layer. Alternatively, the light emitting element LD may be an inorganic light emitting diode, such as a micro light emitting diode (LED) or a quantum dot light emitting diode, formed of inorganic material. As a further alternative, the light emitting element LD may be formed of a combination of organic material and inorganic material.

Although FIG. 2 illustrates that the pixel PX includes a single light emitting element LD, the pixel PX in an embodiment may include a plurality of light emitting elements. The plurality of light emitting elements may be connected in series, parallel or series-parallel to each other. For example, the light emitting element LD may have a structure in which a plurality of light emitting elements (e.g., organic light emitting elements or inorganic light emitting elements) are connected in series, parallel, or series-parallel to each other between the first power line PL1 and a fifth node N5.

The pixel circuit (or the pixel driving circuit) may include at least one transistor and at least one capacitor. For example, the pixel circuit may include first to ninth transistors T1 to T9, a first capacitor C1 (or a storage capacitor), and a second capacitor C2 (or a holding capacitor).

The first transistor T1 (or the driving transistor) may include a first electrode connected to a first node N1, and a second electrode connected to a second node N2. A gate electrode of the first transistor T1 may be connected to a third node N3. The first transistor T1 may control, in response to a voltage of the third node N3, driving current that flows from the first power line PL1, which is configured to provide the first power voltage VDD, to the second power line PL2, which is configured to provide the second power voltage VSS, via the light emitting element LD. For example, the first power voltage VDD may be set to a voltage higher than that of the second power voltage VSS. For example, the first power voltage VDD may be a positive voltage, and the second power voltage VSS may be a negative voltage.

The second transistor T2 may be connected between the j-th data line Dj (hereinafter, referred to as the data line) and a fourth node N4. A gate electrode of the second transistor T2 may be connected to an i-th first scan line S1*i* (hereinafter, referred to as a first scan line). When a first scan signal is supplied to the first scan line S1*i*, the second transistor T2 may be turned on to electrically connect the data line Dj with the fourth node N4.

The third transistor T3 may be connected between the first electrode (or the first node N1) and the gate electrode (or the third node N3) of the first transistor T1. A gate electrode of the third transistor T3 may be connected to an i-th second scan line S2*i* (hereinafter, referred to as a second scan line).

When a second scan signal is supplied to the second scan line S2*i*, the third transistor T3 may be turned on so that the first electrode (or the first node N1) and the gate electrode (or the third node N3) of the first transistor T1 may be electrically connected to each other. In other words, a timing at which the first electrode (e.g., the drain electrode) of the first transistor T1 and the gate electrode of the first transistor T1 are connected to each other may be controlled by the supply of the second scan signal. If the third transistor T3 is turned on, the first transistor T1 may be connected in the form of a diode. In this case, a threshold voltage (Vth) of the first transistor T1 may be compensated for.

The fourth transistor T4 may be connected between the fourth node N4 and a third power line PL3 configured to provide the third power voltage Vref (e.g., the reference voltage). A gate electrode of the fourth transistor T4 may be connected to an i-th third scan line S3*i* (hereinafter, referred to as a third scan line).

When the third scan signal is supplied to the third scan line S3*i*, the fourth transistor T4 may be turned on so that the third power voltage Vref can be supplied to the fourth node N4. For example, the third power voltage Vref may be set to a voltage having a level lower than a minimum level of a data signal to be supplied to the data line Dj.

The fifth transistor T5 may be connected between the third node N3 and the third power line PL3 configured to provide the third power voltage Vref. A gate electrode of the fifth transistor T5 may be connected to an i-th fourth scan line S4*i* (hereinafter, referred to as a fourth scan line).

When the fourth scan signal is supplied to the fourth scan line S4*i*, the fifth transistor T5 may be turned on so that the third power voltage Vref can be supplied to the third node N3.

The fifth transistor T5 may be turned by the supply of the fourth scan signal, so that the third node N3, i.e., the gate electrode of the first transistor T1, may be initialized to the third power voltage Vref.

The sixth transistor T6 may be connected between the fifth node N5 (or the second electrode of the light emitting element LD) and the first node N1 (or the first electrode of the first transistor T1). A gate electrode of the sixth transistor T6 may be connected to an i-th emission control line Ei (hereinafter, referred to as an emission control line).

The sixth transistor T6 may be turned off when an emission control signal is supplied to the emission control line Ei, and may be turned on in the other cases. If the sixth transistor T6 is turned on, the fifth node N5 and the first node N1 may be electrically connected to each other.

The seventh transistor T7 may be connected between the second node N2 (or the second electrode of the first transistor T1) and the second power line PL2. A gate electrode of the seventh transistor T7 may be connected to the emission control line Ei.

The seventh transistor T7 may be turned off when an emission control signal is supplied to the emission control line Ei, and may be turned on in the other cases. If the seventh transistor T7 is turned on, the second node N2 may be electrically connected to the second power line PL2.

If the sixth transistor T6 and the seventh transistor T7 are turned on, a current flow path may be formed between the first power line PL1 and the second power line PL2. In other words, in case that the sixth transistor T6 and the seventh transistor T7 are turned on, driving current may be provided to the light emitting element LD, so that the light emitting element LD may emit light having a luminance corresponding to the amount of driving current. In contrast, if the sixth transistor T6 and the seventh transistor T7 are turned off by the supply of the emission control signal, the current flow path of the driving current may be interrupted, and the light emitting element LD may not emit light.

The eighth transistor T8 may be connected between the fifth node N5 and a fourth power line PL4 configured to provide the fourth power voltage Vint (e.g., the initialization voltage). A gate electrode of the eighth transistor T8 may be connected to an i-th fifth scan line S5*i* (hereinafter, referred to as a fifth scan line).

When the fifth scan signal is supplied to the fifth scan line S5*i*, the eighth transistor T8 may be turned on so that the fourth power voltage Vint can be supplied to the fifth node N5.

If the fourth power voltage Vint is supplied to the second electrode (or the fifth node N5) of the light emitting element LD by the supply of the fifth scan signal, a parasitic capacitor of the light emitting element LD may be discharged. For example, the fourth power voltage Vint may have a voltage level substantially identical with that of the first power voltage VDD, or have a DC voltage having a specific voltage level. Here, as a residual voltage charged into the parasitic capacitor of the light emitting element LD is discharged (removed), undesired fine emission may be prevented. Therefore, the black expression performance of the pixel PX may be enhanced.

The ninth transistor T9 may be connected between the second node N2 (or the second electrode of the first transistor T1) and a fifth power line PL5 configured to provide a fifth power voltage Vbias (or a bias voltage). A gate electrode of the ninth transistor T9 may be connected to the fifth scan line S5*i*.

When the fifth scan signal is supplied to the fifth scan line S5*i*, the ninth transistor T9 may be turned on so that the fifth power voltage Vbias can be supplied to the second node N2. For example, the fifth power voltage Vbias may have a voltage level substantially identical with that of the fourth power voltage Vint (or the first power voltage VDD), or have a DC voltage having a specific voltage level.

A high voltage may be applied to the second electrode (e.g., the source electrode) of the first transistor T1 by turning on the ninth transistor T9. Therefore, the first transistor T1 may have an on-bias state (i.e., be on-baised).

Here, as the fifth power voltage Vbias is periodically supplied to the second node N2, the bias state of the first transistor T1 may be periodically changed, and the threshold voltage characteristics of the first transistor T1 may be changed. Consequently, the characteristics of the first transistor T1 may be prevented from being fixed in a specific state in a low frequency driving operation, and thus deteriorating.

The first capacitor C1 may be connected between the third node N3 and the fourth node N4. The first capacitor C1 may store a voltage difference between the third node N3 and the fourth node N4.

The second capacitor C2 may be connected between the second power line PL2 and the fourth node N4. Since one electrode of the second capacitor C2 is connected to the second power line PL2, the second power voltage VSS that is a static voltage may be continuously supplied to the one electrode of the second capacitor C2. Therefore, the voltage of the fourth node N4 may be retained at voltage levels directly supplied to the fourth node N4, without being affected by other parasitic capacitors. In other words, the second capacitor C2 may function as a holding capacitor.

In an embodiment, the first to ninth transistors T1 to T9 each may be an oxide semiconductor transistor. For example, the first to ninth transistors T1 to T9 each may include an oxide semiconductor layer as an active layer (a semiconductor layer or a channel layer). For example, the first to ninth transistors T1 to T9 each may be an N-type oxide semiconductor transistor.

An oxide semiconductor transistor may be produced through a low temperature process, and have low charge mobility compared to that of the poly-silicon semiconductor transistor. In other words, the oxide semiconductor transistor may have excellent off-current characteristics. Therefore, in case that each of the first to ninth transistors T1 to T9 is formed of an oxide semiconductor transistor, current leakage due to low frequency driving and variable frequency driving may be minimized, so that the display quality can be enhanced.

However, the foregoing is only an example, and the types and kinds of transistors are not limited thereto.

The second power line PL2 for supply of the second power voltage VSS may have a line shape, but the present disclosure is not limited thereto. For example, the second power line PL2 may be a conductive plate type conductive layer. As the second power line PL2 is formed in a line shape or a conductive layer shape, the second power voltage VSS supplied through the second power line PL2 may be involved in a resistance drop (IR drop) depending on a relative position of the pixel component 100 (refer to FIG. 1).

Here, since the pixel PX in accordance with embodiments of the present disclosure includes a light emitting element LD disposed in an inverted structure, the light emitting element LD may be connected to the first power line PL1 rather than to the second power line PL2, so that the resistance drop issue of the second power line PL2 can be removed. Therefore, a voltage deviation on an electrode (e.g., the first electrode, or the second electrode) of the light emitting element LD may be prevented from occurring, so that luminance unevenness can be mitigated.

Figure 3:
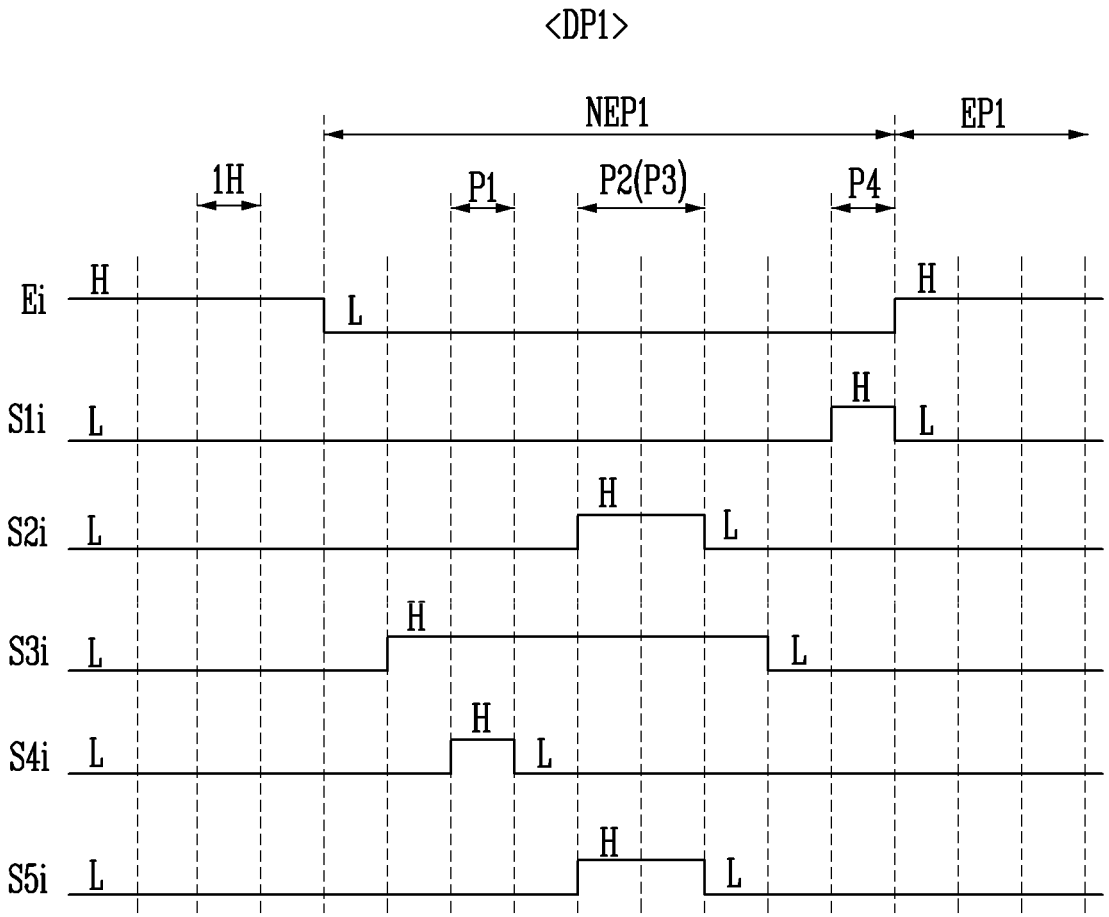
FIG. 3 is a timing diagram illustrating examples of signals to be supplied to the pixel of FIG. 2 in a first driving period.
Figure 4:
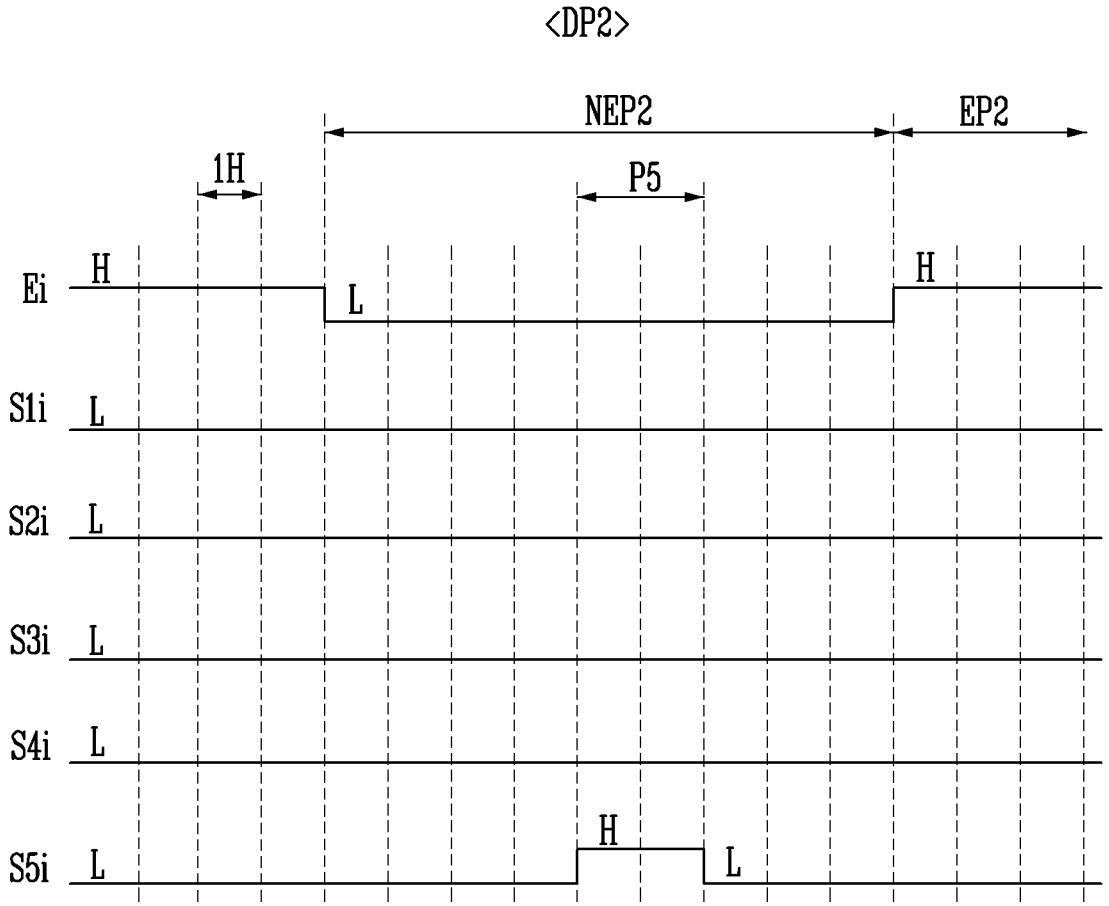
FIG. 4 is a timing diagram illustrating examples of signals to be supplied to the pixel of FIG. 2 in a second driving period.
Figure 5A:
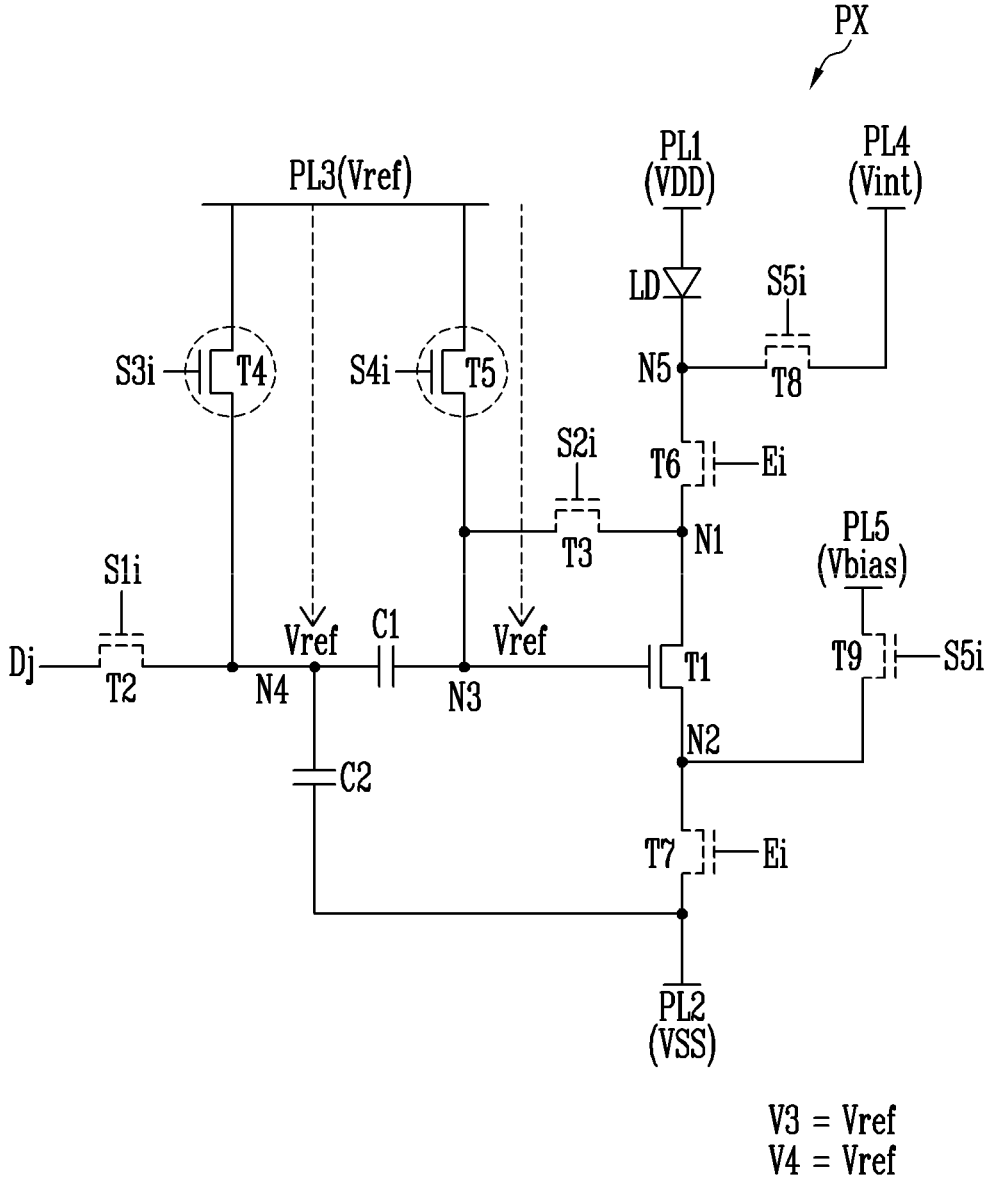
FIGS. 5A, 5B, and 5C are circuit diagrams for describing an example of an operation of the pixel of FIG. 2 during the first driving period.
Figure 5B:
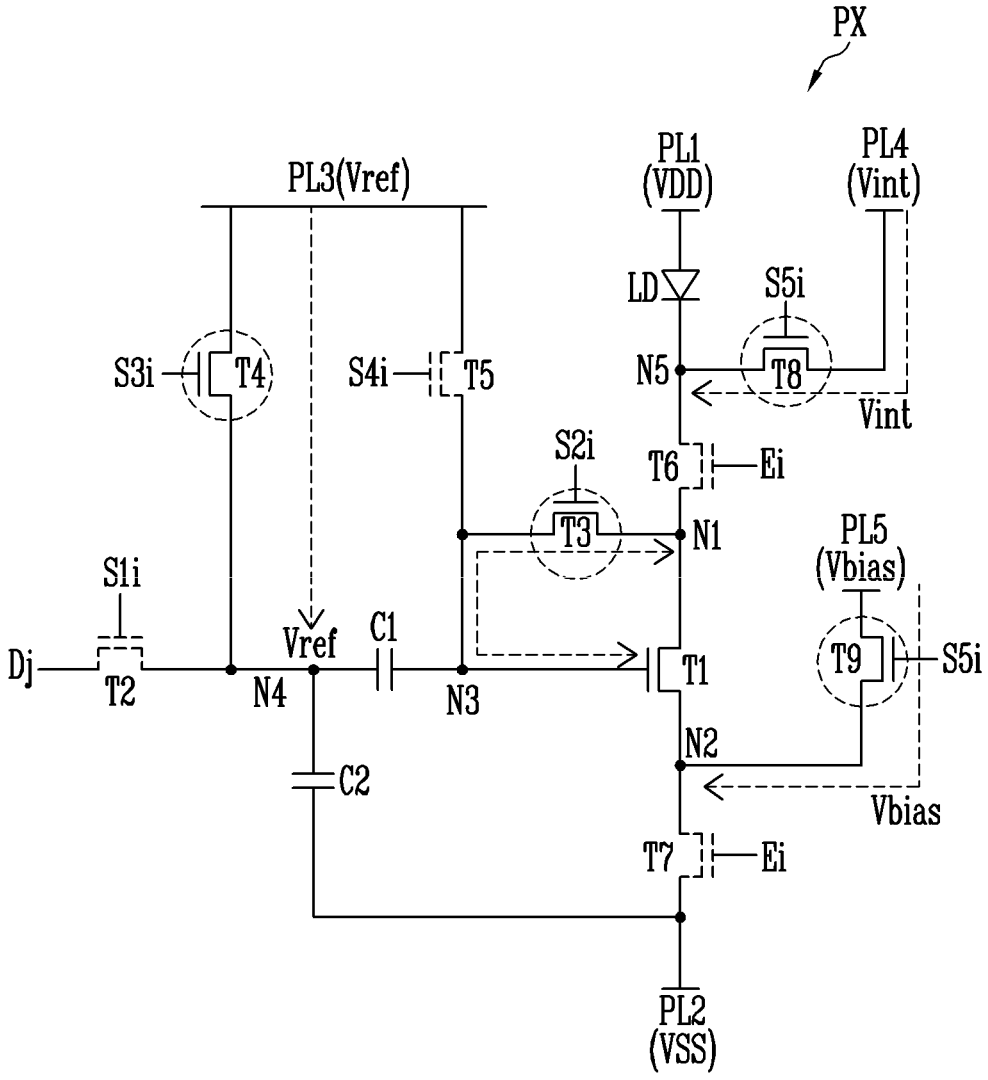
Figure 5C:
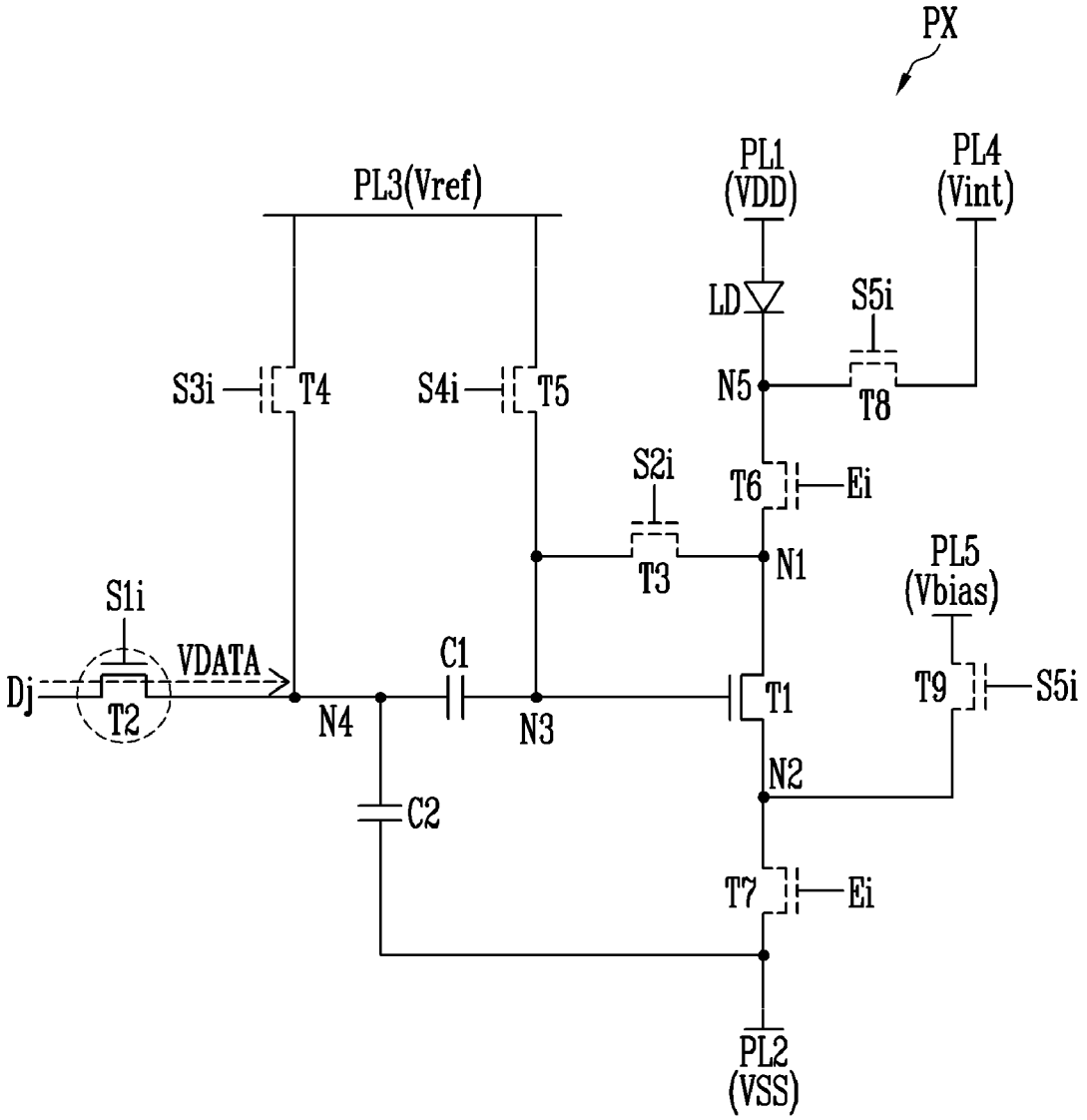

FIG. 3 is a timing diagram illustrating examples of signals to be supplied to the pixel PX of FIG. 2 in the first driving period DP1. FIG. 4 is a timing diagram illustrating examples of signals to be supplied to the pixel PX of FIG. 2 in the second driving period DP2. FIGS. 5A to 5C are circuit diagrams for describing an example of an operation of the pixel PX of FIG. 2 during the first driving period DP1.

Referring to FIGS. 2, 3, and 4, the pixel PX may be operated during the first driving period DP1 or the second driving period DP2.

In a variable frequency driving operation for controlling the frame frequency, each frame period may include the first driving period DP1. Furthermore, the second driving period DP2 may be omitted or performed at least one time depending on the frame frequency.

The first driving period DP1 may include a first non-emission period NEP1 and a first emission period EP1. The second driving period DP2 may include a second non-emission period NEP2 and a second emission period EP2. Here, the first and second non-emission periods NEP1 and NEP2 each may refer to a period during which the current flow path of the driving current that flows from the first power line PL1 to the second power line PL2 via the light emitting element LD is blocked. The first and second emission periods EP1 and EP2 each may refer to a period during which the current flow path of the driving current is formed so that the light emitting element LD emits light based on the driving current.

For example, the first non-emission period NEP1 of the first driving period DP1 and the second non-emission period NEP2 of the second driving period DP2 each may be defined as a period during which the emission control signal is supplied to the emission control line Ei. The first emission period EP1 of the first driving period DP1 and the second emission period EP2 of the second driving period DP2 each may be defined as a period during which the emission control signal is not supplied to the emission control line Ei.

The first driving period DP1 may include a period (e.g., a fourth period P4) in which a data signal that substantially corresponds to an output image is written. During the second driving period DP2, the data signal is not supplied, the first transistor T1 of the pixel PX may be controlled to be in an on-bias state, and the fifth scan signal may be supplied to initialize the light emitting element LD.

As illustrated in FIG. 3, the first driving period DP1 may include the first non-emission period NEP1 and the first emission period EP1. The first non-emission period NEP1 may include first to fourth periods P1 to P4.

In an embodiment, a width of the third scan signal may be greater than that of each of the first, second, fourth, and fifth scan signals.

In an embodiment, the width of the first scan signal to be supplied to the first scan line S1*i* may be the same as that of the fourth scan signal to be supplied to the fourth scan line S4*i*. For example, the first scan signal may be a signal obtained by shifting the fourth scan signal. A width of a period (e.g., the fourth period P4) during which the first scan signal remains at a high level H (or a gate-on level) may be the same as a width of a period (e.g., the first period P1) during which the fourth scan signal remains at a high level H (or a gate-on level). For example, the first scan line S1*i* may share a scan signal with a fourth scan line of an i-k-th pixel row (where k is an integer greater than 0). In this case, line complexity of the display device 1000 (refer to FIG. 1) may be improved, and the production cost may be reduced.

As described with reference to FIG. 2, since the first to ninth transistors T1 to T9 included in the pixel PX are formed of N-type oxide semiconductor transistors, the first to fifth scan signals to be supplied to the second, third, fourth, fifth, eighth, and ninth transistors T2, T3, T4, T5, T8, and T9 each may be at a high level H, and the emission control signal to be supplied to each of the sixth and seventh transistors T6 and T7 may be at a low level L.

The emission control signal may remain at the low level L (or a gate-off level) during the first non-emission period NEP1. Therefore, during the first non-emission period NEP1, the sixth and seventh transistors T6 and T7 may remain turned off, so that the current flow path of the driving current that flows from the first power line PL1 to the second power line PL2 via the light emitting element LD may be blocked during the first non-emission period NEP1.

After the first non-emission period NEP1 starts (or after the emission control signal is supplied to the emission control line Ei), the third scan signal may be supplied to the third scan line S3*i*. If the third scan signal is supplied to the third scan line S3*i*, the fourth transistor T4 may be turned on so that the third power voltage Vref may be supplied from the third power line PL3 to the fourth node N4.

The supply of the third scan signal may be maintained until the fourth period P4 starts. For example, the third scan signal may remain at the high level H until the fourth period P4 starts. During the period in which the third scan signal is supplied, the fourth transistor T4 may remain turned on, and the fourth node N4 may remain at the third power voltage Vref. Consequently, during the first period P1, the second period P2, and the third period P3 that are included in the period in which the third scan signal is supplied, the fourth transistor T4 may remain turned on, and the fourth node N4 may remain at the third power voltage Vref.

During the first period P1, the fourth scan signal may be supplied to the fourth scan line S4*i*. For example, during the first period P1, the fourth scan signal having the high level H (or the gate-on level) may be supplied to the fourth scan line S4*i*. Hence, the fifth transistor T5 may be turned on. In an embodiment, a period in which the fifth transistor T5 is turned on may overlap at least a period in which the fourth transistor T4 is turned on.

Although FIG. 3 illustrates that the fourth scan signal is supplied after the third scan signal is supplied, embodiments of the present disclosure are not limited thereto. For example, a time point at which the third scan signal is supplied (i.e., a time point at which the third scan signal makes a transition to the high level H) may be the same as a time point at which the fourth scan signal is supplied (i.e., a time point at which the fourth scan signal makes a transition to the high level H).

In the first period P1, the fifth transistor T5 is turned on, so that the third power voltage Vref may be supplied to the third node N3.

To be more specific, referring to FIG. 5A, there is illustrated an equivalent circuit of the pixel PX in the first period P1.

As illustrated in FIG. 5A, during the first period P1, the fifth transistor T5 may be turned on. Hence, a voltage V3 of the third node N3 (i.e., the voltage of the gate electrode of the first transistor T1) may be initialized to the third power voltage Vref. The first period P1 may be understood as being a first initialization period as a period in which the voltage V3 of the third node N3 is initialized.

As described above, since a fourth transistor T4 remains turned on during the first period P1, the voltage V4 of the fourth node N4 may remain at the third power voltage Vref.

During the second period P2, the second scan signal may be supplied to the second scan line S2*i*. For example, in the second period P2, the second scan signal having the high level H (or the gate-on level) may be supplied to the second scan line S2*i*. Hence, the third transistor T3 may be turned on. In an embodiment, a period in which the third transistor T3 is turned on may overlap at least a period in which the fourth transistor T4 is turned on.

Here, since the fourth transistor T4 remains turned on during the second period P2, the voltage V4 (refer to FIG. 5A) of the fourth node N4 may remain at the third power voltage Vref.

To be more specific, referring to FIG. 5B, there is illustrated an equivalent circuit of the pixel PX in the second period P2.

As illustrated in FIG. 5B, since the third transistor T3 remains turned on by the supply of the second scan signal, the first transistor T1 may be connected in the form of a diode, and an operation of compensating for the threshold voltage of the first transistor T1 may be performed. The second period P2 may be understood as being a threshold voltage compensation period as a period in which the threshold voltage of the first transistor T1 is compensated for. The second period P2 that is a threshold voltage compensation period may be determined by a length of a period in which the second scan signal is supplied. For example, the second period P2 may be set to two horizontal periods (i.e., 2×1 horizontal periods 1H). In this case, a sufficient amount of threshold voltage compensation time may be secured. Here, one horizontal period 1H may correspond to a time allocated to apply a data signal to one pixel row. For example, in case that an image refresh rate of the display device 1000 (refer to FIG. 1) is 240 Hz, the one horizontal period 1H may be approximately 1.84 μs or less.

However, the foregoing is only an example, and the length of the second period P2 is not limited thereto. The length of the second period P2 may be changed in design depending on driving conditions. For example, the length of the second period P2 in which the second scan signal is supplied may be set to three horizontal periods or more.

During the second period P2, the fourth node N4 is maintained at the third power voltage Vref. Thus, a coupling effect of the first capacitor C1 may be substantially removed. In other words, since there is no change in the voltage V4 (refer to FIG. 5A) of the fourth node N4, the voltage V3 of the third node N3 may be changed to a value corresponding to a difference (e.g., Vref−Vth) between the third power voltage Vref and the threshold voltage (Vth) of the first transistor T1. Hence, the threshold voltage (Vth) of the first transistor T1 may be stored in the first capacitor C1.

During the third period P3, the fifth scan signal may be supplied to the fifth scan line S5*i*. For example, during the third period P3, the fifth scan signal having the high level H (or the gate-on level) may be supplied to the fifth scan line S5*i*. Hence, the eighth transistor T8 and the ninth transistor T9 may be turned on.

The second period P2 and the third period P3 may be the same period. For example, the second scan signal and the fifth scan signal may be supplied during the same period (i.e., the second period P2, the third period P3).

The foregoing is only an example, and the second scan signal and the fifth scan signal may be supplied during different periods.

Hereinafter, description will be made on the assumption that the second period P2 and the third period P3 are the same as each other.

If during the third period P3 the eighth transistor T8 and the ninth transistor T9 are turned on, the fourth power voltage Vint may be supplied to the fifth node N5, and the fifth power voltage Vbias may be supplied to the second node N2.

To be more specific, referring to FIG. 5B, the fourth power voltage Vint may be supplied to the fifth node N5 (or the second electrode of the light emitting element LD) by turning on the eighth transistor T8. In other words, the voltage V5 of the fifth node N5 may be initialized to the fourth power voltage Vint. If the fourth power voltage Vint is supplied to the second electrode of the light emitting element LD, a residual voltage charged into the parasitic capacitor of the light emitting element LD may be discharged (or removed) so that undesired fine emission may be prevented. Hence, the pixel PX may have more uniform luminance characteristics. The third period P3 may be understood as being a second initialization period as a period in which the light emitting element LD is initialized.

Furthermore, the fifth power voltage Vbias may be supplied to the second node N2 (or the second electrode of the first transistor T1) by turning on the ninth transistor T9. If the fifth power voltage Vbias is supplied to the second electrode (e.g., the source electrode) of the first transistor T1, the first transistor T1 may be controlled to be in an on-bias state before light is emitted. The third period P3 may be understood as being a first bias period as a period in which the first transistor T1 is controlled to be in the on-bias state. In other words, the first bias period and the second initialization period may be the same (or overlapping) period.

Before the fourth period P4 after the second period P2 and the third period P3, the supply of the third scan signal is interrupted (e.g., the third scan signal to be supplied to the third scan line S3*i* makes a transition to a low level L), and the fourth transistor T4 may be turned off. The foregoing is only an example. The interruption of the supply of the third scan signal may be performed simultaneously with the termination of the second period P2 and the third period P3.

Thereafter, during the fourth period P4, the first scan signal may be supplied to the first scan line S1*i*. For example, during the fourth period P4, the first scan signal having the high level H (or the gate-on level) may be supplied to the first scan line S1*i*. Hence, the second transistor T2 may be turned on.

To be more specific, referring to FIG. 5C, there is illustrated an equivalent circuit of the pixel PX in the fourth period P4.

As illustrated in FIG. 5C, during the fourth period P4, the second transistor T2 may be turned on. Hence, a voltage of a data signal of a present frame (hereinafter, referred to as a present data voltage VDATA) that is provided through the data line Dj may be supplied to the fourth node N4 through the second transistor T2.

Therefore, the voltage V4 of the fourth node N4 may be changed from the third power voltage Vref to the present data voltage VDATA. In this case, the voltage V3 of the third node N3 may be changed from the existing value corresponding to the difference (e.g., Vref−Vth) between the third power voltage Vref and the threshold voltage (Vth) of the first transistor T1 to a value (e.g., Vref−Vth+α) obtained by reflecting a coupling component (α) of the first capacitor C1 and the second capacitor C2 on the existing value. Here, the coupling component (α) of the first capacitor C1 and the second capacitor C2 may be determined depending on a variation (e.g., VDATA-Vref) of the voltage V4 of the fourth node N4 and a ratio of a first capacitance (Cp1) of the first capacitor C1 and a second capacitance (Cp2) of the second capacitor C2 (for example, $\alpha=[Cp1/(Cp1+Cp2)]\times[VDATA-Vref]$).

Thereafter, the supply of the emission control signal is interrupted (e.g., the emission control signal makes a transition to the high level H), so that the first non-emission period NEP1 may be terminated, and the first emission period EP1 may proceed. During the first emission period EP1, the sixth and seventh transistors T6 and T7 may be turned on.

During the first emission period EP1, driving current corresponding to the present data voltage VDATA written in the fourth period P4 (or the voltage V3 of the third node N3 that has changed in response to the present data voltage VDATA written in the fourth period P4) may be supplied to the light emitting element LD. The light emitting element LD may emit light based on the driving current.

As illustrated in FIG. 4, the second driving period DP2 may include the second non-emission period NEP2 and the second emission period EP2. The second non-emission period NEP2 may include a fifth period P5.

In an embodiment, a waveform of the emission control signal in the second driving period DP2 may be substantially the same as a waveform of the emission control signal in the first driving period DP1.

In an embodiment, during the second driving period DP2, the first to fourth scan signals may not be supplied. For example, during the second driving period DP2, the first to fourth scan signals each having the low level L (or the gate-off level) may be respectively supplied to the first to fourth scan lines S1*i*, S2*i*, S3*i*, and S4*i*. Hence, the second to fifth transistors T2 to T5 may remain turned off.

During the second non-emission period NEP2, the fifth scan signal may be supplied to the fifth scan line S5*i* in the fifth period P5. For example, in the third period P5, the fifth scan signal having the high level H (or the gate-on level) may be supplied to the fifth scan line S5*i*. Hence, the eighth and ninth transistors T8 and T9 may be turned on. Here, an operation of the pixel PX in the fifth period P5 may be substantially equal or similar to an operation of the pixel PX in the third period P3 described with reference to FIG. 3.

In other words, the fifth period P5 may be understood as being a third initialization period in which the light emitting element LD is initialized by turning on the eighth transistor T8. Furthermore, the fifth period P5 may be understood as being a second bias period in which the first transistor T1 is controlled to be in an on-bias state by turning on the ninth transistor T9.

As described with reference to FIGS. 1 to 5C, in the pixel PX and the display device 1000 including the pixel PX in accordance with embodiments of the present disclosure, a sufficient amount of threshold voltage compensation time may be secured, without an effect of a previous data voltage, by the circuit structure of the pixel PX of FIG. 2 and controlling signals to be supplied to the pixel PX. As a bias voltage (e.g., the fifth power voltage Vbias) is periodically applied to the driving transistor (e.g., the first transistor T1), deterioration in display quality due to variation in hysteresis characteristics of the driving transistor can be prevented (or removed). Furthermore, since the first and second driving periods DP1 and DP2 are used to drive the pixel PX, image quality for various frame frequencies may be improved.

Furthermore, in the pixel PX and the display device 1000 including the pixel PX in accordance with embodiments of the present disclosure, the light emitting element LD may be disposed to have an inverted structure in the circuit structure of the pixel PX, as illustrated in FIG. 2. Hence, a resistance drop issue of the second power voltage VSS may be removed, so that luminance unevenness can be mitigated.

In addition, the first to ninth transistors T1 to T9 included in the pixel PX including the light emitting element LD disposed in the inverted structure are formed of N-type oxide semiconductor transistors, so that current leakage due to low frequency driving and variable frequency driving may be minimized, whereby the display quality can be enhanced.

Figure 6A:
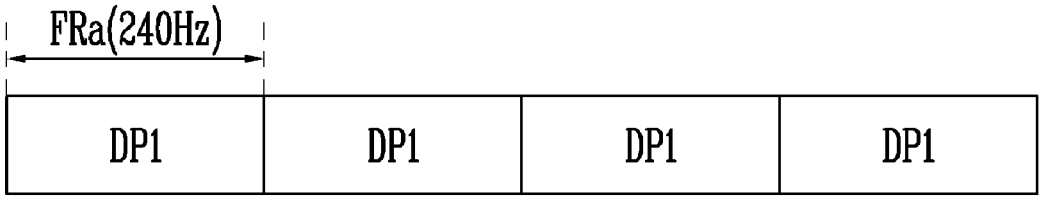
FIGS. 6A, 6B, and 6C are diagrams each illustrating an example of an operation of the display device of FIG. 1 according to a frame frequency.
Figure 6B:
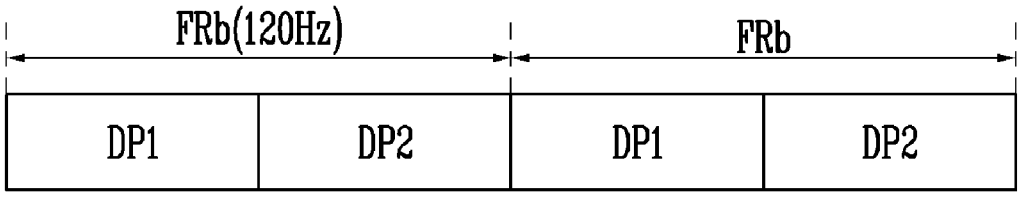
Figure 6C:
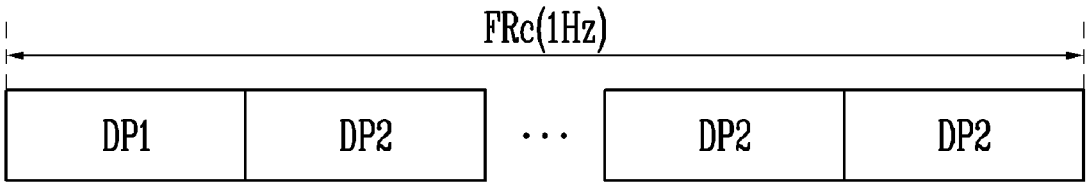

FIGS. 6A to 6C are diagrams each illustrating an example of an operation of the display device 1000 of FIG. 1 according to a frame frequency.

Referring to FIGS. 1, 3, 4, and 6A to 6C, the display device 1000 may be driven at various frame frequencies.

The frequency of the first driving period DP1 may correspond to a frame frequency.

In an embodiment, as illustrated in FIG. 6A, the first frame FRa may include a first driving period DP1. For example, in case that the frequency of the first driving period DP1 is 240 Hz, the display device 1000 may be driven at a frame frequency of 240 Hz during the first frame FRa. For example, the first driving period DP1 and the first frame FRa may be approximately 4.17 ms in length.

In an embodiment, as illustrated in FIG. 6B, the second frame FRb may include a first driving period DP1 and a second driving period DP2. For example, the first driving period DP1 and the second driving period DP2 may be repeated. In this case, the display device 1000 may be driven at a frame frequency of 120 Hz during the second frame FRb. For example, the first driving period DP1 and the second driving period DP2 may be approximately 4.17 ms in length. The second frame FRb may be approximately 8.33 ms in length.

In an embodiment, as illustrated in FIG. 6C, the third frame FRc may include a first driving period DP1 and a plurality of repetitive second driving periods DP2. For example, in case that the display device 1000 may be driven at a frame frequency of 1 Hz during the third frame FRc, the length of the third frame FRc may be approximately 1 second. In the third frame FRc, the second driving period DP2 may be repeated approximately 239 times.

As such, the display device 1000 may be driven at various frame frequencies (e.g., 1 Hz to 480 Hz) without limit by controlling the number of repetitions of the second driving period DP2 in each frame.

Figure 7:
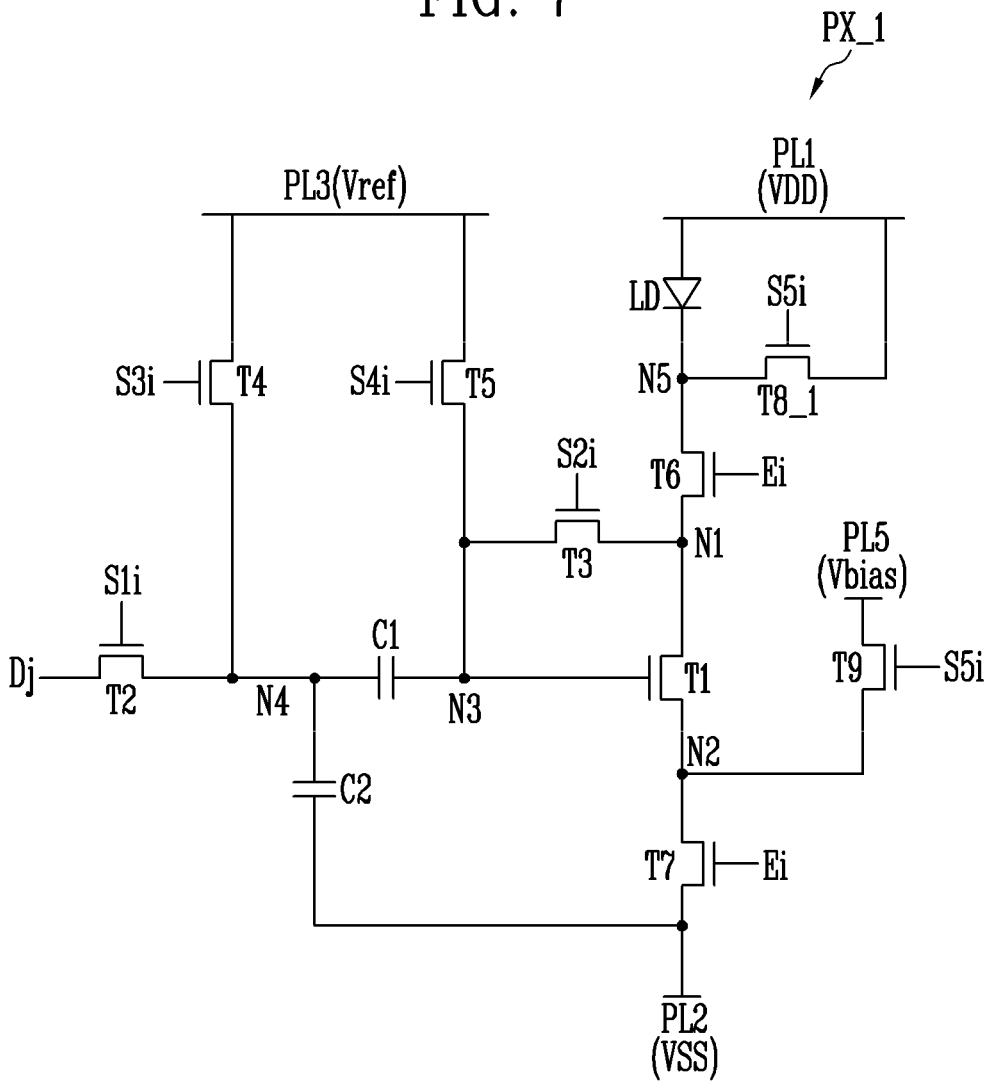
FIG. 7 is a circuit diagram illustrating an example of a pixel included in the display device of FIG. 1.

FIG. 7 is a circuit diagram illustrating an example of a pixel PX_1 included in the display device 1000 of FIG. 1.

A pixel PX_1 of FIG. 7, other than the fact that an eighth transistor T8_1 is connected between the first power line PL1 and the fifth node N5, is substantially the same as the pixel PX described with reference to FIG. 2. Therefore, like reference numerals will be used to designate components equal to or similar to those of FIG. 2, and redundant explanation thereof will be omitted.

Referring to FIG. 7, the pixel PX_1 may include a light emitting element LD, first to ninth transistors T1 to T7, T8_1, and T9, a first capacitor C1, and a second capacitor C2.

Here, as described with reference to FIG. 2, a voltage (e.g., the fourth power voltage Vint of FIG. 2) for initializing the light emitting element LD may have substantially the same voltage level as that of the first power voltage VDD.

In other words, even if as illustrated in FIG. 7 the eighth transistor T8_1 included in the pixel PX_1 is connected to the first power line PL1, the pixel PX_1 of FIG. 7 may be operated in the substantially the same manner as that of the pixel PX of FIG. 2.

In this case, unlike the pixel PX of FIG. 2, the fourth power line PL4 (refer to FIG. 2) for providing the fourth power voltage Vint (refer to FIG. 2) may be omitted. Consequently, line complexity of the display device 1000 (refer to FIG. 1) may be improved, and the production cost may be reduced.

Figure 8:
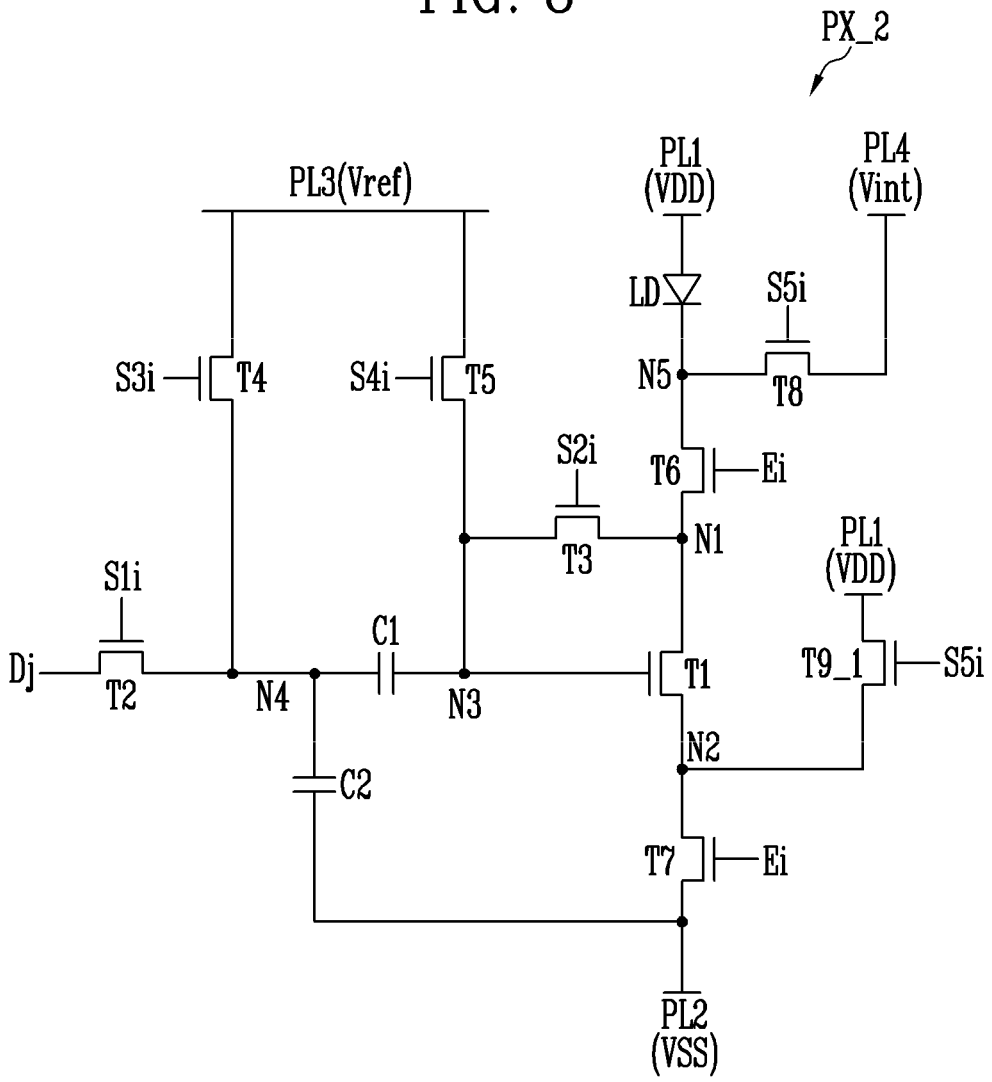
FIG. 8 is a circuit diagram illustrating an example of a pixel included in the display device of FIG. 1.

FIG. 8 is a circuit diagram illustrating an example of the pixel PX_2 included in the display device 1000 of FIG. 1.

A pixel PX_2 of FIG. 8, other than the fact that a ninth transistor T9_1 is connected between the first power line PL1 and the second node N2, is substantially the same as the pixel PX described with reference to FIG. 2. Therefore, like reference numerals will be used to designate components equal to or similar to those of FIG. 2, and redundant explanation thereof will be omitted.

Referring to FIG. 8, the pixel PX_2 may include a light emitting element LD, first to ninth transistors T1 to T8, and T9_1, a first capacitor C1, and a second capacitor C2.

Here, as described with reference to FIG. 2, a voltage (e.g., the fifth power voltage Vbias of FIG. 2) for controlling the first transistor T1 to be in an on-bias state may have substantially the same voltage level as that of the first power voltage VDD.

In other words, even if as illustrated in FIG. 8 the ninth transistor T9_1 included in the pixel PX_2 is connected to the first power line PL1, the pixel PX_2 of FIG. 8 may be operated in the substantially the same manner as that of the pixel PX of FIG. 2.

In this case, unlike the pixel PX of FIG. 2, the fifth power line PL5 (refer to FIG. 2) for providing the fifth power voltage Vbias (refer to FIG. 2) may be omitted. Consequently, line complexity of the display device 1000 (refer to FIG. 1) may be improved, and the production cost may be reduced.

Figure 9:
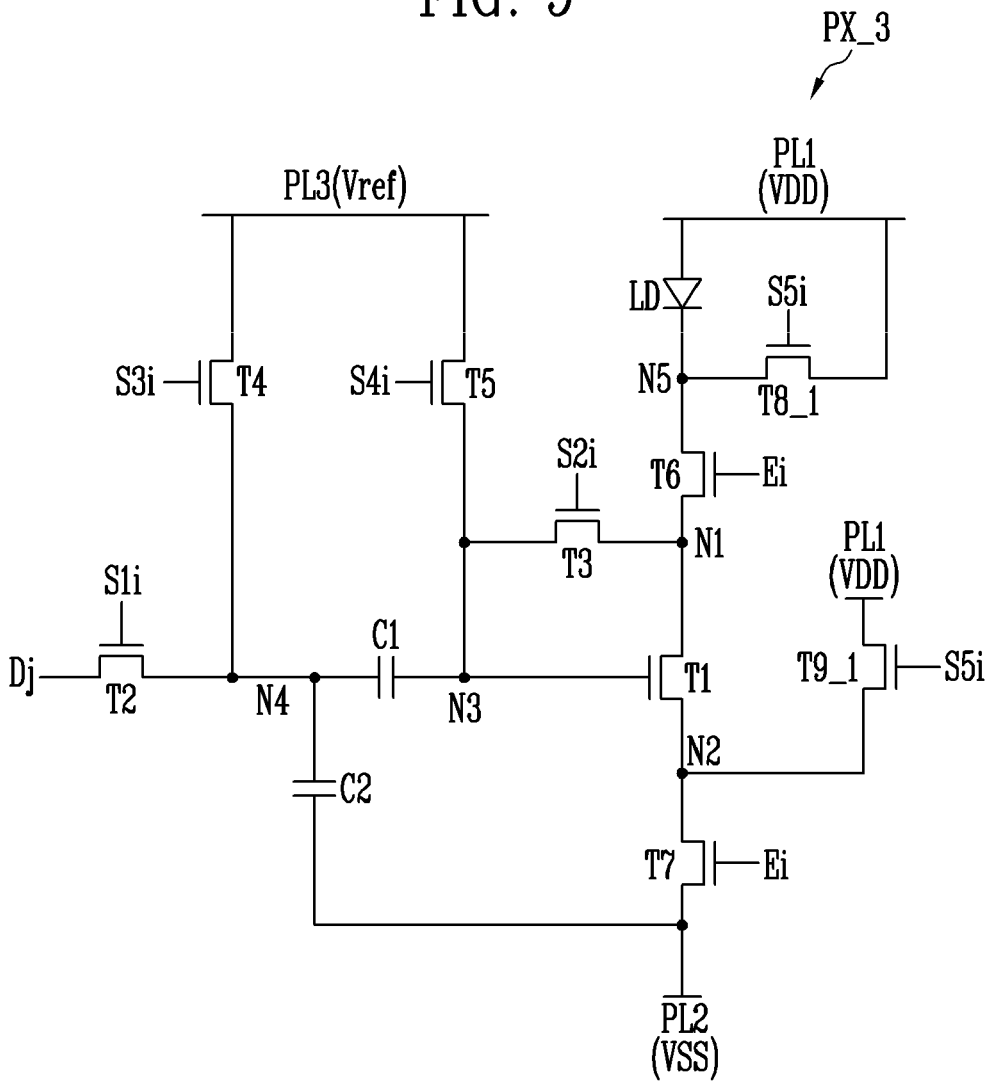
FIG. 9 is a circuit diagram illustrating an example of a pixel included in the display device of FIG. 1.

FIG. 9 is a circuit diagram illustrating an example of the pixel PX_3 included in the display device 1000 of FIG. 1.

The pixel PX_3 of FIG. 9, other than the fact that an eighth transistor T8_1 is connected between the first power line PL1 and the fifth node N5 and a ninth transistor T9_1 is connected between the first power line PL1 and the second node N2, is substantially the same as the pixel PX described with reference to FIG. 2. Therefore, like reference numerals will be used to designate components equal to or similar to those of FIG. 2, and redundant explanation thereof will be omitted.

Referring to FIG. 9, the pixel PX_3 may include a light emitting element LD, first to ninth transistors T1 to T7, T8_1, and T9_1, a first capacitor C1, and a second capacitor C2.

Here, as described with reference to FIG. 2, a voltage (e.g., the fourth power voltage Vint of FIG. 2) for initializing the light emitting element LD may have substantially the same voltage level as that of the first power voltage VDD. A voltage (e.g., the fifth power voltage Vbias of FIG. 2) for controlling the first transistor T1 to be in the on-bias sate may have substantially the same voltage level as that of the first power voltage VDD.

In other words, even if as illustrated in FIG. 9 the eighth transistor T8_1 included in the pixel PX_3 is connected to the first power line PL1 and the ninth transistor T9_1 is connected to the first power line PL1, the pixel PX_3 of FIG. 9 may be operated in the substantially the same manner as that of the pixel PX of FIG. 2.

In this case, unlike the pixel PX of FIG. 2 (or the pixels PX_1 and PX_2 of FIGS. 7 and 8), the fourth power line PL4 (refer to FIG. 2) for providing the fourth power voltage Vint (refer to FIG. 2) and the fifth power line PL5 (refer to FIG. 2) for providing the fifth power voltage Vbias (refer to FIG. 2) may be omitted. Consequently, line complexity of the display device 1000 (refer to FIG. 1) may be improved, and the production cost may be reduced.

In a pixel and a display device including the pixel in accordance with embodiments of the present disclosure, a light emitting element may be disposed to have an inverted structure. Hence, a resistance drop issue may be removed, so that luminance unevenness can be mitigated.

Furthermore, the pixel and the display device including the pixel in accordance with embodiments of the present disclosure may include N-type oxide semiconductor transistors, so that the display quality can be prevented from deteriorating due to current leakage in the pixel when a low frequency driving operation is performed.

Furthermore, in the pixel and the display device including the pixel in accordance with embodiments of the present disclosure, a sufficient amount of threshold voltage compensation time may be secured, and a bias voltage may be periodically applied to the driving transistor, so that deterioration in display quality due to variation in hysteresis characteristics of the driving transistor can be prevented (or removed).

Moreover, since first and second driving periods may be used to drive the pixel, image quality for various frame frequencies may be improved.

However, effects of the present disclosure are not limited to the above-described effects, and various modifications are possible without departing from the spirit and scope of the present disclosure.

While embodiments of the present disclosure have been described above, those skilled in the art will appreciate that various modifications, additions and substitutions are possible, without departing from the scope and spirit of the appended claims.

What is claimed is:

1. A pixel comprising:

a light emitting element including a first electrode and a second electrode;

a first transistor connected between a first node and a second node, and configured to generate driving current flowing from a first power line for providing a first power voltage to a second power line for providing a second power voltage via the light emitting element;

a second transistor connected between a data line and a fourth node, and configured to be turned on in response to a first scan signal supplied to a first scan line;

a third transistor connected between the first node and a third node corresponding to a gate electrode of the first transistor, and configured to be turned on in response to a second scan signal supplied to a second scan line;

a fourth transistor connected between the fourth node and a third power line for providing a third power voltage, and configured to be turned on in response to a third scan signal supplied to a third scan line;

a fifth transistor connected between the third node and the third power line, and configured to be turned on in response to a fourth scan signal supplied to a fourth scan line;

a sixth transistor connected between the first node and a fifth node corresponding to the second electrode of the light emitting element, and configured to be turned off in response to an emission control signal supplied to an emission control line;

a seventh transistor connected between the second node and the second power line, and configured to be turned off in response to the emission control signal; and a first capacitor connected between the third node and the fourth node.

2. The pixel according to claim 1, wherein the first electrode of the light emitting element is connected to the first power line.

3. The pixel according to claim 1, wherein each of the first to seventh transistors is an N-type oxide semiconductor transistor.

4. The pixel according to claim 1, further comprising an eighth transistor connected between the fifth node and a fourth power line for providing a fourth power voltage, and configured to be turned on in response to a fifth scan signal supplied to a fifth scan line.

5. The pixel according to claim 1, further comprising an eighth transistor connected between the fifth node and the first power line, and configured to be turned on in response to a fifth scan signal supplied to a fifth scan line.

6. The pixel according to claim 1, further comprising a ninth transistor connected between the second node and a fifth power line for providing a fifth power voltage, and configured to be turned on in response to a fifth scan signal supplied to a fifth scan line.

7. The pixel according to claim 1, further comprising a ninth transistor connected between the second node and the first power line, and configured to be turned on in response to a fifth scan signal supplied to a fifth scan line.

8. The pixel according to claim 1, further comprising a second capacitor connected between the second power line and the fourth node.

9. The pixel according to claim 1, wherein a period in which the third transistor is turned on overlaps at least a portion of a period in which the fourth transistor is turned on.

10. The pixel according to claim 1, wherein a period in which the fifth transistor is turned on overlaps at least a portion of a period in which the fourth transistor is turned on.

11. The pixel according to claim 1, wherein the first scan signal is a signal obtained by shifting the fourth scan signal.

12. A display device comprising:

a pixel connected to a first scan line, a second scan line, a third scan line, a fourth scan line, a fifth scan line, an emission control line, and a data line;

a scan driver configured to supply a first scan signal, a second scan signal, a third scan signal, a fourth scan signal, and a fifth scan signal to the first scan line, the second scan line, the third scan line, the fourth scan line and the fifth scan line, respectively;

an emission driver configured to supply an emission control signal to the emission control line; and a data driver configured to supply a data signal to the data line, wherein the pixel comprises:

a light emitting element including a first electrode and a second electrode;

a first transistor connected between a first node and a second node, and configured to generate driving current flowing from a first power line for providing a first power voltage to a second power line for providing a second power voltage via the light emitting element;

a second transistor connected between the data line and a fourth node, and configured to be turned on in response to the first scan signal;

a third transistor connected between the first node and a third node corresponding to a gate electrode of the first transistor, and configured to be turned on in response to the second scan signal;

a fourth transistor connected between the fourth node and a third power line for providing a third power voltage, and configured to be turned on in response to the third scan signal;

a fifth transistor connected between the third node and the third power line, and configured to be turned on in response to the fourth scan signal;

a sixth transistor connected between the first node and a fifth node corresponding to the second electrode of the light emitting element, and configured to be turned off in response to the emission control signal;

a seventh transistor connected between the second node and the second power line, and configured to be turned off in response to the emission control signal; and a first capacitor connected between the third node and the fourth node.

13. The display device according to claim 12, wherein the first electrode of the light emitting element is connected to the first power line.

14. The display device according to claim 12, wherein each of the first to seventh transistors is an N-type oxide semiconductor transistor.

15. The display device according to claim 12, wherein the pixel further comprises an eighth transistor connected between the fifth node and a fourth power line for providing a fourth power voltage, and configured to be turned on in response to the fifth scan signal.

16. The display device according to claim 12, wherein the pixel further comprises an eighth transistor connected between the fifth node and the first power line, and configured to be turned on in response to the fifth scan signal.

17. The display device according to claim 12, wherein the pixel further comprises a ninth transistor connected between the second node and a fifth power line for providing a fifth power voltage, and configured to be turned on in response to the fifth scan signal.

18. The display device according to claim 12, wherein the pixel further comprises a ninth transistor connected between the second node and the first power line, and configured to be turned on in response to the fifth scan signal.

19. The display device according to claim 12, wherein the pixel further comprises a second capacitor connected between the second power line and the fourth node.

20. The display device according to claim 12, wherein a period in which the scan driver supplies the second scan signal overlaps at least a portion of a period in which the scan driver supplies the third scan signal.

* * * * *